US012209829B2

(12) United States Patent
Reis-Green et al.

(10) Patent No.: US 12,209,829 B2
(45) Date of Patent: Jan. 28, 2025

(54) FIREARM SILENCER AND MUZZLE ACCESSORY COUPLING DEVICE, USER COMPATIBILITY IMPROVEMENT

(71) Applicants: Austin Reis-Green, Watertown, WI (US); Evan Reis-Green, Juneau, WI (US)

(72) Inventors: Austin Reis-Green, Watertown, WI (US); Evan Reis-Green, Juneau, WI (US)

( * ) Notice: Subject to any disclaimer, the term of this patent is extended or adjusted under 35 U.S.C. 154(b) by 98 days.

(21) Appl. No.: 17/818,218

(22) Filed: Aug. 8, 2022

(65) Prior Publication Data

US 2023/0148295 A1 May 11, 2023

Related U.S. Application Data

(63) Continuation-in-part of application No. 16/948,730, filed on Sep. 30, 2020, now Pat. No. 11,408,702.

(60) Provisional application No. 63/253,517, filed on Oct. 7, 2021, provisional application No. 63/039,642, filed on Jun. 16, 2020.

(51) Int. Cl.
*F41A 21/32* (2006.01)
*F41A 21/48* (2006.01)

(52) U.S. Cl.
CPC ..... *F41A 21/325* (2013.01); *F41A 21/482* (2013.01)

(58) Field of Classification Search
CPC ..... F41A 21/30–38; F41A 21/482
USPC ..... 89/14.2–14.4; 181/223
See application file for complete search history.

(56) References Cited

U.S. PATENT DOCUMENTS

| | | | | |
|---|---|---|---|---|
| 7,735,406 | B1 * | 6/2010 | Olson | F41A 21/325 89/14.3 |
| 9,182,187 | B1 * | 11/2015 | Griffith | F41A 21/325 |
| 9,500,427 | B1 * | 11/2016 | Larue | F41A 21/30 |
| 9,739,560 | B1 * | 8/2017 | Salvador | F41A 21/34 |
| 9,921,021 | B1 * | 3/2018 | Graham, II | F41A 21/325 |
| 10,082,355 | B2 * | 9/2018 | Addis | F41A 21/36 |
| 10,184,745 | B1 * | 1/2019 | Fulton | F41A 21/30 |
| 10,612,878 | B1 * | 4/2020 | Salvador | F41A 21/325 |
| 2010/0229712 | A1 * | 9/2010 | Graham | F41A 21/34 42/76.01 |
| 2012/0180623 | A1 * | 7/2012 | Graham | F41A 21/325 89/14.4 |
| 2016/0202013 | A1 * | 7/2016 | Lessard | F41A 21/325 89/14.05 |
| 2017/0205178 | A1 * | 7/2017 | Niswander | F41A 21/325 |
| 2018/0128566 | A1 * | 5/2018 | Reis Green | F41A 21/30 |
| 2019/0353446 | A1 * | 11/2019 | Kras | F41A 21/325 |
| 2020/0173750 | A1 * | 6/2020 | Riley | F41A 21/30 |

(Continued)

*Primary Examiner* — Joshua E Freeman
*Assistant Examiner* — Benjamin S Gomberg
(74) *Attorney, Agent, or Firm* — Dunlap Bennett & Ludwig PLLC

(57) ABSTRACT

A firearm muzzle accessory coupling device improvement system and method. The coupling device provides a front alignment taper of 17-25 degrees included angle, and an intermediate outer diameter providing a thread of 14 to 18 threads per inch. The muzzle accessory provides a mounting interface socket having an operatively associated thread on the inner circumference of a through bore. The threads of the coupling device and muzzle accessory effectuate mating between the coupling device and the firearm muzzle accessory in a single axial orientation.

10 Claims, 4 Drawing Sheets

(56) References Cited

U.S. PATENT DOCUMENTS

| | | | | |
|---|---|---|---|---|
| 2021/0356225 | A1* | 11/2021 | Kras | F41A 21/325 |
| 2023/0228516 | A1* | 7/2023 | Reis Green | F41A 21/325<br>89/14.05 |

* cited by examiner

FIREARM SILENCER AND MUZZLE ACCESSORY COUPLING DEVICE, USER COMPATIBILITY IMPROVEMENT

CROSS-REFERENCE TO RELATED APPLICATION

This application claims the benefit of priority of U.S. provisional application No. 63/253,517, filed 7 Oct. 2021, as well as U.S. non-provisional application Ser. No. 16/948,730, filed 30 Sep. 2020 as a continuation in part, the contents of both are herein incorporated by reference.

BACKGROUND OF THE INVENTION

The present invention relates to an improved mounting system for pistol silencers, specifically for pistols which require a Neilson device, also referred to as a recoil booster to achieve reliable function, and, more particularly, a firearm muzzle accessory coupling device, system, and method.

This patent relates to an invention of an improvement to our invention that is the subject matter of application Ser. No. 16/948,730. This improvement simplifies mounting for a percentage of customers who, for a variety of reasons have difficulties with understanding or enjoying the benefits of the system of Ser. No. 16/948,730. Henceforth, for the purposes of clarity, we will refer to the system of Ser. No. 16/948,730 as our trademark name, "CAM-LOK" which is a registered trademark in the 013 IC.

The background of CAM-LOK can be read in application Ser. No. 16/948,730 but isn't necessary for understanding our improvement for certain percentage of customers who have issues with CAM-LOK.

CAM-LOK provided the world's fastest pistol silencer attachment system, and eliminated inadvertent loosening of pistol silencers, which was a pandemic problem with legacy direct thread silencer pistons. CAM-LOK further provided the ability to configure pistol silencers and firearms of different makes, models, and calibers, for convenient fully interchangeable future use. Prior to CAM-LOK, silencers needed to be constantly retrofitted with an assortment of pistons to allow attachment on various make and model pistols with various thread pitch barrels. CAM-LOK benefits were obtained by providing a triple interrupted, patterned thread and using a barrel provided with a coupler, thread installed with a tool using approximately 22 in-lbs. of torque. A tapered gas seal was provided on the coupler and the receiving piston and provided prevailing torque necessary to keep the suppressor mounted during shooting. The required prevailing torque was derived through application of approximately 22-32 in-lbs. of installation torque-values easily achieved by hand, without tools. The mate of the tapers also provided a gas seal which kept the system from leaking gas, and from fouling the mating threads. The relationship of installation torque to required prevailing torque was derived through the application of the aforementioned light mounting torque, and the use of a non-standard thread pitch to profile relationship whereby the 16TPI thread form was cut at a 10TPI or .100" helix. The triple interrupted and patterned thread allowed for the installation of the silencer in three positions, assisting in the rapidity of installation. POI shift with the system was negligible and minimal between the three positions with properly manufactured pistol silencers such as those made by my company Griffin Armament.

The mounting process of CAM-LOK is as follows:

1. Bayonet insert the coupler into the CAM-LOK piston and press the components together on the barrel axis.
2. Turn the firearm clockwise in relation to the barrel axis until the coupler drops fully onto the barrel coupler.
3. Keep pressure clockwise in relation to the barrel axis on the pistol and pull the silencer away from the pistol.
4. The silencer will move approximately eight thousandths of an inch, whereupon the threads will mesh, resulting in vigorous twisting of the pistol about the barrel axis for approximately 55 degrees.
5. Apply the 22-36 in-lb. of torque and stop when a slight squish of the sealing tapers engaging is felt.
6. The pistol is now ready to fire, and this total process will take approximately 2.5 seconds to complete.

Most end users of CAM-LOK have been absolutely elated and have delivered very positive remarks on the innovative qualities and have made comments about CAM-LOK totally revolutionizing pistol silencer operation. Comments have typically mentioned universality, convenience, speed, and especially satisfaction pertaining to the elimination of the need to check tighten silencers every 2-3 rounds to prevent inadvertent loosening and baffle strikes. In the first 15 months, we sold over ten thousand CAM-LOK parts to thousands of customers, but we encountered a few customers in the process who had complaints and misgivings about the system.

Most of the complaints involved customers having issues understanding the mounting procedure on initial reception of the system and failing to put the silencer fully onto the receiving barrel coupler, before turning the interrupted threads through engagement, thereby failing to mount the silencers. A still smaller number of people had issues aggressively overtightening the system through engagement of the threads, prompting an adjustment of manufacturing tolerances to reduce mounted axial thread engagement for greater over-torque tolerance—an improvement to the CAM-LOK system. An even smaller number of people seemed to have issues failing to tighten the silencer to the minimum 22 in-lb. A very small minority of people would prefer the silencer had one mounting orientation and less complexity than this already rather simple system.

Our idea to resolve the minority user issues with a separately available, lower cost, simplified improvement product for the approximately 2% of customers who are unhappy with, or who lack ideal confidence in the original system for a variety of reasons, is to replace the triple interrupted thread with 16 TPI conventional thread shortened to approximately 2-3 total threads. This will retain the durable 16TPI thread profile, eliminate the ability to either twist or over-torque through engagement, and increase the prevailing torque approximately 60% for a given input mounting torque by replacing the CAM-LOK's .100" helix with a more mechanically advantaged .0625" helix. This reduces possible mounting orientations to one single orientation, reduces required minimum suppressor mounting torque to approximately 13.75 in-lb., and takes the steps required to mount the silencer down to 4 steps:

1. Bayonet mount the suppressor piston onto the barrel end coupler.
2. Thread the silencer two to three rotations onto the coupler.
3. Torque the silencer to 13.75 in-lb. or until the squish of the tapers mating is felt.
4. The silencer is now ready to fire. The total process will take about 7 seconds to complete.

The alternate simplified and improved product we plan to trademark "EZ-LOK". We have applied to register the trademark EZ-LOK. EZ-LOK will retain the resolution of pistol silencer inadvertent loosening taught with CAM-LOK. EZ-LOK will simplify the mounting process for customers who have difficulty and want the product to be natively simple with no required learning or understanding time or effort. The required learning and effort for CAM-LOK is typically a few minutes, but some end users refuse to provide any mental effort to learn unique systems, and EZ-LOK is meant to be compatible with those users. EZ-LOK will draw on end users experience with bottles, lids, and lightbulbs—things adults have already experienced and learned. The EZ-LOK embodies a quick disconnect silencer interface.

As can be seen, there is a need for a practical silencer mounting system that addresses the desire of end users to easily and without conceptual understanding or training, with positive mounting security, and with a high degree of coaxial alignment, attach a sound suppressor, including one with a "Nielsen device" or recoil booster, without major negative attributes such as loss of accuracy, inadvertent loosening, loss of system temperature resistance, increase in baffle strike risk, increase in weight or size, etc.

SUMMARY OF THE INVENTION

In one aspect of the present invention, a novel pistol silencer piston mounting interface and barrel end coupler system is provided. A novel barrel end coupler capable of mating with the suppressor mounting interface socket in one axial orientation is also provided. The primary means of attachment is a short conventional thread of 14 to 18TPI pitch. The mounting interface comprises a unique socket geometry natively manufactured into a pistol silencer piston, also known to those skilled in the art as a Nielsen device piston or booster piston. The unique socket permits a novel means of attaching a pistol silencer to a pistol. The mounting interface may also provide a novel capability to retrofit an existing pistol silencer at minimal cost, with replacement of the booster piston, providing faster attachment and more secure mounting, without added suppressor length, to Browning style unlocking automatic pistols which are known to require the assistance of a Nielsen device or booster for reliable function.

In another aspect of the present invention, a system of coupling a muzzle accessory to a firearm includes the following: the above-mentioned firearm coupling device; the companion muzzle coupling mated accessory having a through bore extending through the inside of a receiving portion and a sealing alignment taper; and an inner diameter of the receiving portion having a short portion threaded 14-18TPI, wherein the threaded portion is dimensioned to operatively associate with the outside diameter thread of the body in such a way as to permit bayonet insertion successively followed by threaded assembly to a limiting point of contact between the sealing alignment taper of the barrel coupler body and the sealing alignment taper of the silencer piston socket, whereby the threads enable a single axial mounting orientation between said firearm coupling device and the muzzle accessory.

In yet another aspect of the present invention, a muzzle accessory coupling system, includes a coupling interface having the following: a body terminating at a body taper, wherein the body taper is approximately 17 to 25 degrees included angle; a through bore circumscribed by the body; and an outer diameter of the body having an external thread; and a socket extending from a rear end to a forward end; an internal thread dimensioned to operatively associate with the external thread of the body, wherein the internal thread is inward of the rear end enabling bayonet insertion prior to a first mechanical communication between said threads; a socket taper at the forward end, wherein the socket taper is dimensions to snugly receive the body taper, and wherein the internal thread is spaced apart from the forward end and the forward end so that the first mechanical communication is required prior to a second mechanical communication between said tapers, whereby a rigid alignment of bores of the coupling interface and the socket is obtained.

In yet still another aspect of the present invention, the muzzle accessory coupling system further includes wherein the bore of the body is threaded for attachment to a threaded firearm barrel, wherein the coupling interface is natively manufactured into a barrel of a firearm, wherein the coupling interface has a rear portion comprising a tool receiving feature, wherein the socket is associated with a piston interfacing with a muzzle accessory, wherein the external thread comprises 14 to 18 thread per inch, wherein the first mechanical communication comprising rotation driven by approximately 17-inch-pounds of torque, wherein the first mechanical communication is prevented by a third revolution about said threads, enabling a limited point of contact, wherein the external thread comprises approximately 2-3 total threads, and wherein the external threads comprise a 16TPI thread profile.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Referring now to FIGS. 1 through 7, the present invention may include firearm muzzle accessory coupling device, system, and method.

Figure 7:
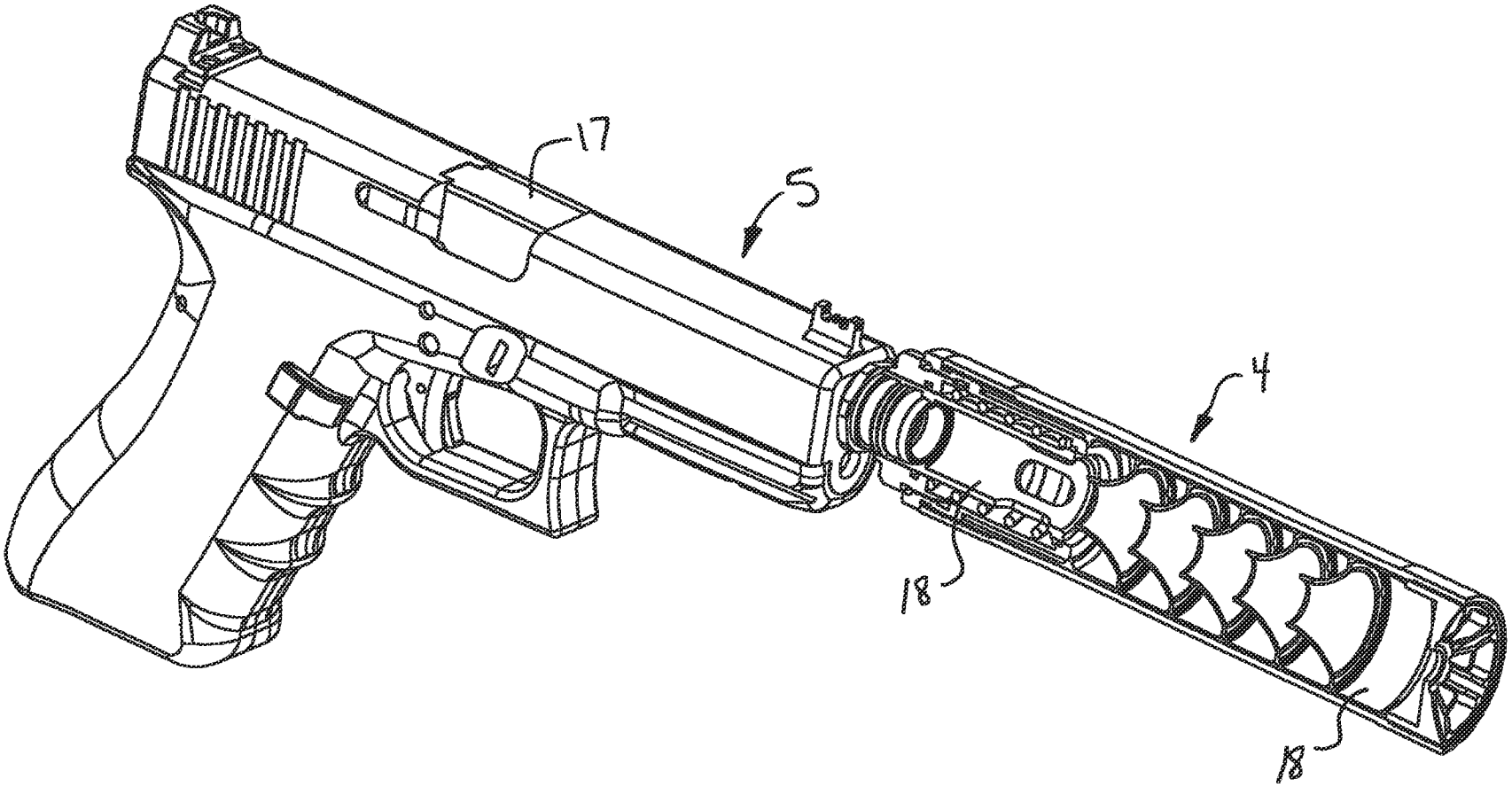
FIG. 7 is a perspective view of a Glock 17 with the thread attached BEC of FIG. 6 permitting mounting of a silencer 4 in cutaway view that was adapted to be mounted by retrofitting it with the NDP or BPI of FIG. 3.

Referring to FIG. 7 for definitional establishment, as used herein, the word "forward" or "front" corresponds with the firing direction of the firearm—i.e., the cartridge (in the breech or "rear" end of the barrel 17) fires with projectile exiting the "forward" or "front" side of each of the parts in assembly.

The outside diameter is defined as outer circumference of parts coaxially surrounding the inside diameter defined by the bore 18 permitting the passage of the projectile fired from the barrel 17 of the firearm 5 when the parts representing an embodiment of the invention are in assembly, such as seen in FIG. 7.

Figure 1:
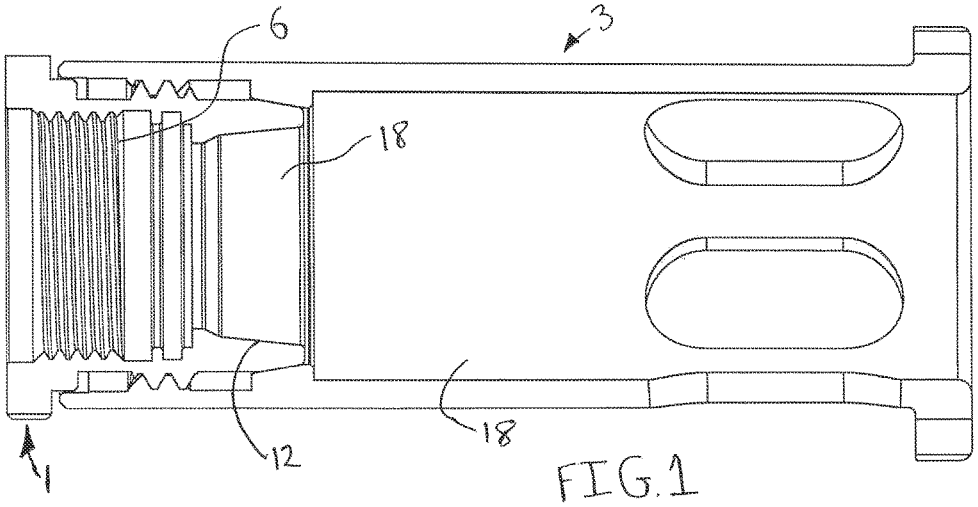
FIG. 1 is a section view of an exemplary embodiment of the present invention embodied in a Nielsen device piston (NDP) or booster piston insert (BPI) and a barrel end coupler (BEC)
Figure 2:
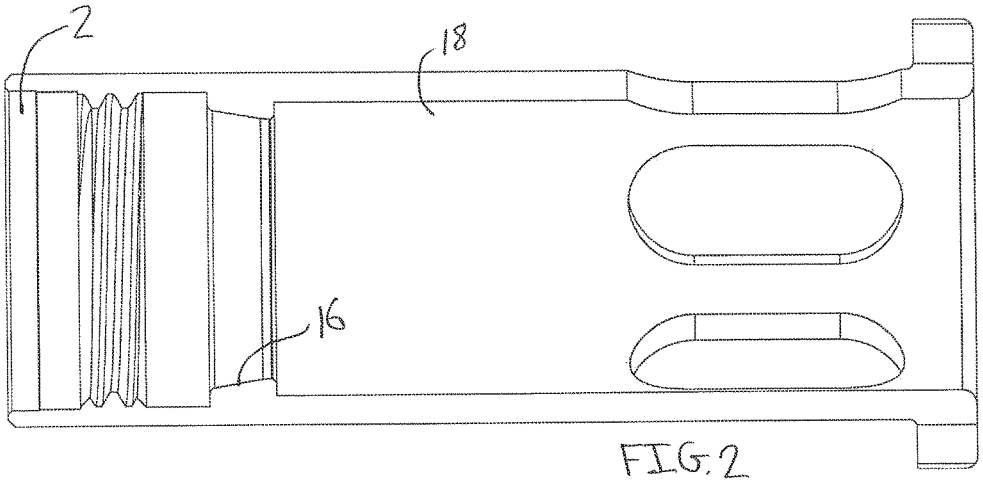
FIG. 2 is a section view of an exemplary embodiment of the NDP or BPI of FIG. 1.
Figure 3:
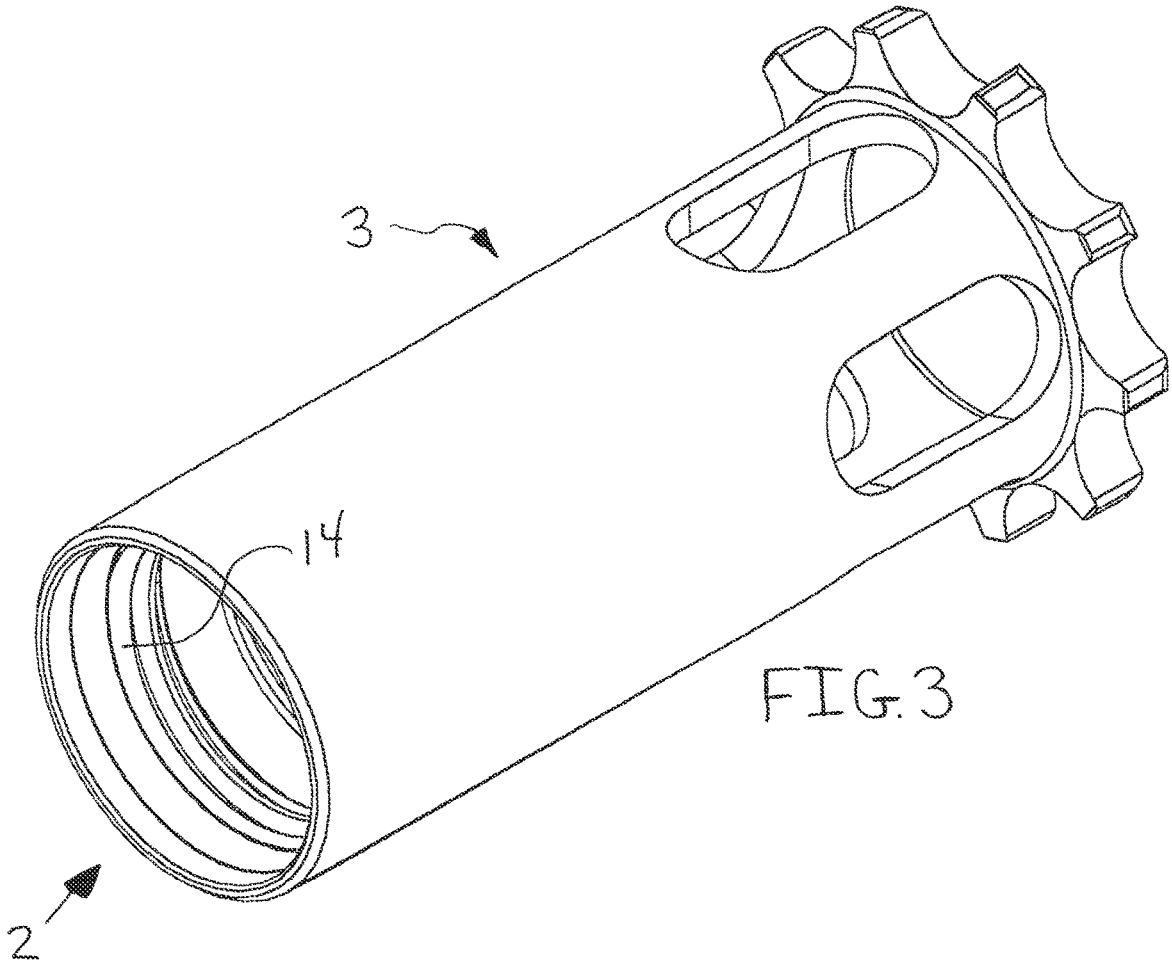
FIG. 3 is a perspective view of an exemplary embodiment of the NDP or BPI of FIG. 1.
Figure 4:
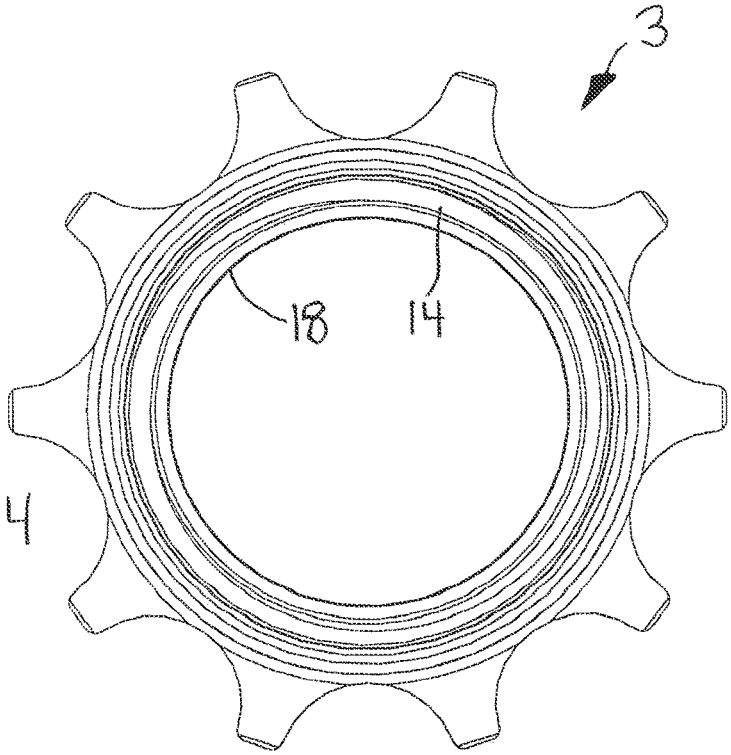
FIG. 4 is a rear view of an exemplary embodiment of the NDP or BPI of FIG. 1.
Figure 5:
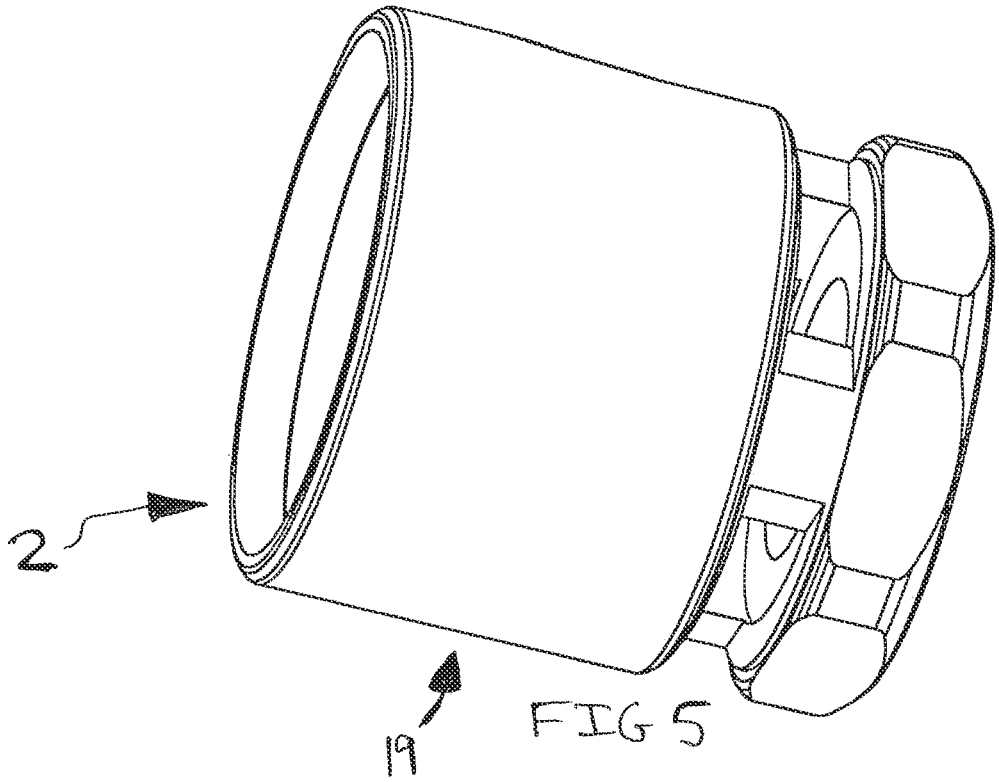
FIG. 5 is a perspective view of an exemplary embodiment of a muzzle brake (muzzle accessory) compatible with the barrel end coupler of FIG. 6.
Figure 6:
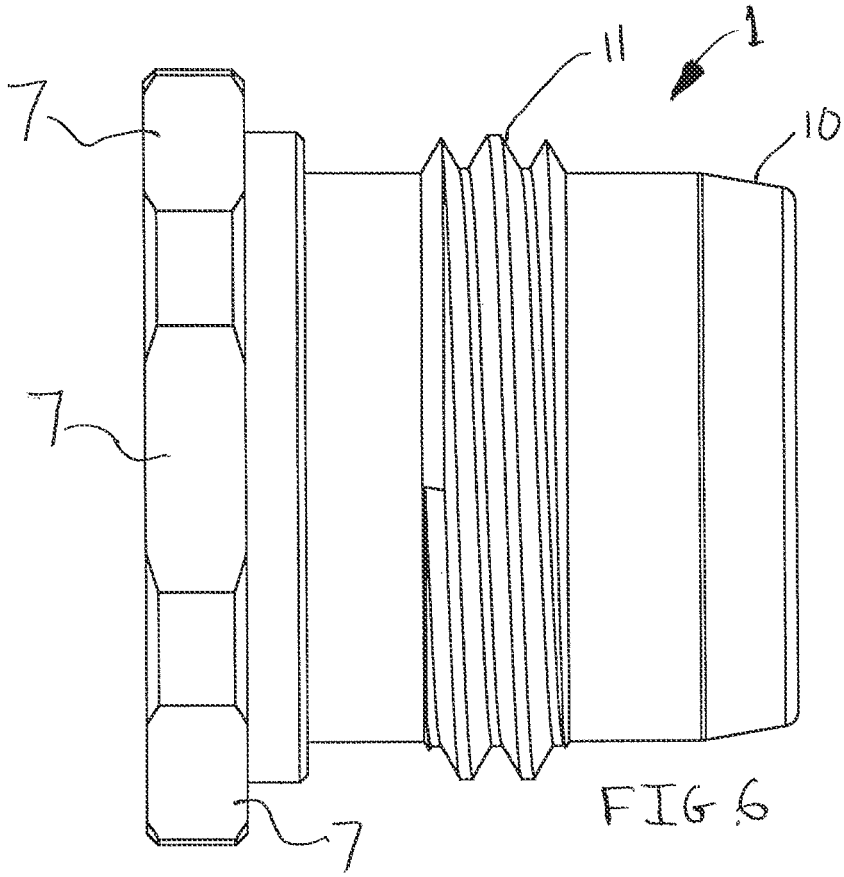
FIG. 6 is a side view of an exemplary embodiment of the BEC of FIG. 1.

As shown in FIGS. 1,6 and 7, the present invention pertains to a novel firearm mounting coupler 1 capable of mating with a socket geometry comprising a novel mating interface 2. In one embodiment the mating interface 2 may be natively manufactured into a muzzle accessory such as muzzle brake 19, or into a Nielsen device or recoil booster piston 3 hereinafter referred to as the piston 3. The coupler 1, interfacing piston 3, and sound suppressor 4 each have through bores 18 which when assembled are generally coaxial with the barrel 17 of a firearm 5, permitting the passage of a projectile fired from the mated barrel 17 of the firearm 5.

The coupler 1 features an internal thread 6 allowing it to be mounted to the threaded end of a barrel 17 of a firearm 5, and an external thread 11, allowing it to be operatively associated to internal thread 14 of the piston 3 or muzzle accessory 19.

The thread 11 may be several different industry patterns such as but not limited to UNF, UNEF, or STUB ACME, and may have a helix of .071"–.055" per rotation, or 14-18TPI. Altering the helix angle slightly within the range of 14-18TPI may be desirable to adjust the mounting and prevailing torque of the system.

The coupler 1 may include a tool receiving feature or plurality of tool-receiving features such as the wrench flats 7 allowing the coupler 1 to be securely installed to the firearm 5. A portion of the diameter of the coupler 1 forward of the threads defines an alignment taper 10 of an included angle between 17 and 25 degrees. The adjustment of the taper angle of taper 10 provides a secondary means of adjusting mounting and prevailing torque requirements for the system. The alignment taper 10 is also capable of providing a gas seal in assembly to protect the threads from combustion debris and to promote proper function of the attached sound suppressor or muzzle device. The coupler 1 may also serve a secondary purpose as a muzzle device such as a flash suppressor, muzzle brake, or compensator. The coupler 1 shown in FIG. 1 shows a miniature cone type flash suppressor 12. The coupler 1 may also receive a mating interface accessory that itself provides a function traditionally associated with a muzzle device, such as a muzzle brake 19.

Referring to FIGS. 2, 4, 5, 6 and 7, for the sake of this description, the firearm 5 in FIG. 7 has been configured with installation of the coupler 1 to the threaded barrel 17 of the firearm 5 and suppressor 4 has been configured for novel function by replacement of the prior art piston with a piston 3 wherein the mating interface socket 2 of the invention is integrated into the piston 3. The novel mating interface socket 2 of piston 3 features thread 14 which allows of coupler 1 to bayonet into the bore 2 of piston 3, until the threads 14 and 11 contact. Once threads 14 and 11 contact, axial rotation of the piston 3 relative to the coupler 1 (e.g., rotation of the piston 3 or barrel bore axis rotation of piston 3 or firearm 5 and coupler 1) causes threads 14 and 11 to engage. This rotational tightening of the barrel 17 attached coupler 1 relative to the piston 3 brings alignment taper 10 of the barrel coupler 1 into contact with socket taper 16 of the mating interface socket or piston 3.

The contact between sealing alignment tapers 10 and 16 removes tolerance and applies a friction/compression fit permitting no vibration to occur. At this point the piston 3 (of the muzzle accessory, e.g., a sound suppressor 4) is securely attached to the coupler 1 and thus the barrel 17 of the firearm 5. The firearm 5 is now in a firing configuration for use with the suppressor 4, and the respective bores 18 of the barrel 17, coupler 1, piston 3, and suppressor 4 are in alignment, permitting the passage of the bullet fired from the firearm 5.

It should be noted that the silencer using the piston 3 and coupler 1 shown can be securely attached in only one orientation afforded by the device as shown in the drawings. This single orientation mounting method of the preferred embodiment requires a maximum of three revolutions to mount the silencer. The addition of more thread would afford greater strength, and the deletion of thread engagement would afford greater rapidity of attachment. The preferred embodiment is an ideal balance of strength and speed for the intended primary application of a pistol silencer booster piston. It should be understood that the coupler 1 could be natively manufactured into the pistol barrel 17 of pistols with barrels greater than .671" outside diameter. A pistol barrel 17 with coupler 1 natively machined into the barrel would also be possible to operatively associate with the interface bore 2 of the piston 3. The combination of a barrel 17 with coupler 1 natively machined into the barrel 17, and a piston 3 with compatible interface bore 2 of the type described above would not depart from the spirit and scope of the following claims.

As used in this application, the term "about" or "approximately" refers to a range of values within plus or minus 10% of the specified number. And the term "substantially" refers to up to 80% or more of an entirety. Recitation of ranges of values herein are not intended to be limiting, referring instead individually to any and all values falling within the range, unless otherwise indicated, and each separate value within such a range is incorporated into the specification as if it were individually recited herein.

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the invention as set forth in the following claims.

What is claimed is:

1. A muzzle accessory coupling system for a suppressor, the system comprising:

a mounting coupler comprising:

an alignment taper at a front end of the mounting coupler, wherein the alignment taper is approximately 17 to 25 degrees included angle;

a tool receiving portion; and a midportion directly interconnecting the alignment taper and the tool receiving portion, wherein an outer surface of the midportion is uniformly cylindrical but for a male external thread, and wherein the tool receiving portion has a diameter greater than said outer surface; and a recoil booster piston comprising:

a socket formed along and entirely within an interior of the recoil booster piston, wherein the socket extends from a rear end to a forward end, and the socket comprising;

an internal thread dimensioned to operatively associate with the male external thread, wherein the internal thread is forward of the rear end, enabling insertion of the mounting coupler into the socket prior to a first mechanical communication between the internal thread and the male external thread;

a socket taper at the forward end, wherein the socket taper is dimensioned and shaped to snugly receive the alignment taper, and wherein the internal thread is spaced apart from the forward end so that the first mechanical communication is required prior to a second mechanical communication between said tapers, whereby bores of the mounting coupler, the recoil booster piston, and the socket are aligned.

2. The muzzle accessory coupling system of claim 1, wherein the bore of the mounting coupler is threaded for attachment to a threaded firearm barrel.

3. The muzzle accessory coupling system of claim 1, wherein the mounting coupler is natively manufactured into a barrel of a firearm.

4. The muzzle accessory coupling system of claim 1, wherein the male external thread comprises 14 to 18 threads per inch (TPI).

5. The muzzle accessory coupling system of claim 1, wherein the first mechanical communication between the internal thread and the male external thread is achieved when the internal threads are rotated by approximately 17-inch-pounds of torque with respect to the male external thread.

6. The muzzle accessory coupling system of claim 1, wherein the second mechanical communication between the alignment taper and the socket taper is achieved when the socket is rotated a maximum of three revolutions with respect to the mounting coupler.

7. The muzzle accessory coupling system of claim 1, wherein the male external thread comprises approximately 2-3 total threads.

8. The muzzle accessory coupling system of claim 1, wherein the male external thread comprises a thread profile of 16 threads per inch (TPI).

9. The muzzle accessory coupling system of claim 1, further comprising an inner surface of the mounting coupler having a continuous conic flash suppressor communicating with the forward end of the socket.

10. A muzzle accessory coupling system for a suppressor, the system comprising:

a mounting coupler comprising:

an alignment taper, wherein the alignment taper is approximately 17 to 25 degrees included angle, an outer surface of the mounting coupler having a male external thread;

a bore of the mounting coupler is threaded for attachment to a threaded firearm barrel; and an inner surface of the mounting coupler having a continuous conic flash suppressor; and a recoil booster piston comprising:

a socket formed along and entirely within an interior of the recoil booster piston, wherein the socket extends from a rear end to a forward end, and the socket comprising:

an internal thread dimensioned to operatively associate with the male external thread, wherein the internal thread is forward of the rear end enabling insertion of the mounting coupler into the socket prior to a first mechanical communication between the internal thread and the male external thread; and a socket taper at the forward end, wherein the socket taper is dimensioned to snugly receive the alignment taper, wherein the internal thread is spaced apart from the forward end so that the first mechanical communication is required prior to a second mechanical communication between said tapers, wherein the first mechanical communication between the internal thread and the male external thread is achieved when the internal threads are rotated by approximately 17-inch-pounds of torque with respect to the male external thread, wherein the second mechanical communication between the alignment taper and the socket taper is achieved when the socket is rotated a maximum of three revolutions with respect to the mounting coupler, wherein the male external thread comprises approximately 2-3 total threads, and wherein the male external thread comprises a thread profile of 16 threads per inch, whereby the continuous conic flash suppressor directly communicates with the forward end of the socket.

* * * * *